US011248835B1

(12) United States Patent
Nuss et al.

(10) Patent No.: US 11,248,835 B1
(45) Date of Patent: Feb. 15, 2022

(54) QUICK RELEASE HANDLE INCLUDING LIGHTS AND SOUND

(71) Applicant: Haier US Appliance Solutions, Inc., Wilmington, DE (US)

(72) Inventors: Bart Andrew Nuss, Fisherville, KY (US); Jonathan Charles Crosby, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/088,927

(22) Filed: Nov. 4, 2020

(51) Int. Cl.

| | |
|---|---|
| ***F25D 27/00*** | (2006.01) |
| ***F25D 23/02*** | (2006.01) |
| ***E05B 1/00*** | (2006.01) |
| ***A47B 88/919*** | (2017.01) |
| ***A47L 15/42*** | (2006.01) |

(52) U.S. Cl.
CPC ..... *F25D 27/005* (2013.01); *A47B 88/919* (2017.01); *A47L 15/4257* (2013.01); *A47L 15/4274* (2013.01); *E05B 1/0084* (2013.01); *F25D 23/028* (2013.01); *A47B 2220/005* (2013.01); *A47B 2220/0077* (2013.01); *A47B 2220/13* (2013.01)

(58) Field of Classification Search
CPC ..... A47B 95/02; A47B 88/919; F25D 27/005; F25D 23/028; A47L 15/4257; A47L 15/4274; E05B 1/0084
USPC ..... 312/405, 348.4, 348.6
See application file for complete search history.

(56) References Cited

U.S. PATENT DOCUMENTS

| | | | | |
|---|---|---|---|---|
| 5,727,858 | A * | 3/1998 | Shapiro | A47B 95/02 312/348.6 |
| 8,003,923 | B2 * | 8/2011 | Wilsdorf | G09F 9/33 219/506 |
| 8,732,910 | B1 | 5/2014 | David | |
| 8,810,423 | B2 * | 8/2014 | Kaczmarek | A47L 15/4293 340/679 |
| 2003/0081401 | A1 * | 5/2003 | Camarota | B60Q 1/2669 362/23.15 |
| 2003/0209018 | A1 * | 11/2003 | Becke | A47L 15/4293 62/126 |
| 2006/0232997 | A1 * | 10/2006 | Rosenbauer | F25D 29/005 362/621 |
| 2008/0244869 | A1 | 10/2008 | Jong-Hyeok | |
| 2010/0011696 | A1 * | 1/2010 | Zimmer | F16B 13/045 52/698 |
| 2012/0285527 | A1 * | 11/2012 | Goldblatt | H01L 31/022433 136/256 |
| 2013/0125345 | A1 | 5/2013 | Bernd | |

(Continued)

FOREIGN PATENT DOCUMENTS

| | | | | |
|---|---|---|---|---|
| CN | 103913029 B | | 3/2016 | |
| DE | 20002649 | * | 6/2001 | A47B 95/02 |

(Continued)

*Primary Examiner* — James O Hansen
(74) *Attorney, Agent, or Firm* — Dority & Manning, P.A.

(57) ABSTRACT

A drawer assembly for an appliance includes a drawer front including a retainer post extending from the drawer front, a handle including an indicator assembly, an attachment assembly for removably attaching the handle to the drawer front, and an electrical connection assembly passing through the attachment assembly to provide electrical power to the indicator assembly.

20 Claims, 4 Drawing Sheets

(56) References Cited

U.S. PATENT DOCUMENTS

| | | | | |
|---|---|---|---|---|
| 2014/0007381 | A1* | 1/2014 | Huang | A47B 95/02 16/421 |
| 2016/0150881 | A1* | 6/2016 | Weissenbach | A47B 95/02 312/237 |
| 2018/0010846 | A1* | 1/2018 | Snyder | H05B 45/20 |
| 2020/0041194 | A1 | 2/2020 | Erika | |
| 2020/0217515 | A1* | 7/2020 | Wantland | F24C 15/024 |

FOREIGN PATENT DOCUMENTS

| | | | | |
|---|---|---|---|---|
| DE | 102006001614 | * | 7/2007 | A47B 96/00 |
| EP | 1808095 | * | 7/2007 | A47B 95/02 |
| KR | 20140088371 A | | 7/2014 | |

* cited by examiner

QUICK RELEASE HANDLE INCLUDING LIGHTS AND SOUND

FIELD OF THE INVENTION

The present subject matter relates generally to appliance handles, and more particularly to quick release handles with electronic multimedia capabilities.

BACKGROUND OF THE INVENTION

Various types of consumer appliances include handles that operate to open and close compartments such as drawers, chambers, and the like. For example, appliances such as refrigerators, ovens, and dishwashers include broad handles that may span a width of the appliance. However, conventional appliance handles are typically fixed to the appliance, e.g., using mechanical fasteners or the like. Removing these handles is typically a tedious and time-consuming process that requires the use of one or more tools to remove the fasteners and/or handle.

Conventional appliances also typically include one or more displays or indicators for communicating information to a user of the appliance. These displays require electrical power and their positioning is commonly restricted to those portions of appliance that may be hard-wired, e.g., such as on a cabinet or door front of the appliance.

Accordingly, it would be beneficial to have an improved handle assembly for an appliance that obviates one or more of the above-mentioned drawbacks. More specifically, a handle assembly for an appliance that is quickly and easily removable, facilitates improved user interaction, and exhibits improved aesthetics would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a drawer assembly for an appliance is provided. The drawer assembly may include a drawer front comprising a retainer post extending from the drawer front, a handle comprising an indicator assembly, an attachment assembly for removably attaching the handle to the drawer front, and an electrical connection assembly passing through the attachment assembly to provide electrical power to the indicator assembly.

In another exemplary aspect of the present disclosure, a refrigerator appliance is provided. The refrigerator appliance may include a cabinet defining a fresh food storage chamber and a frozen food storage chamber, and a drawer slidably mounted within one of the fresh food storage chamber and the frozen food storage chamber and defining a drawer recess. The drawer may include a drawer front comprising a retainer post extending from the drawer front, a handle comprising an indicator assembly, an attachment assembly for removably attaching the handle to the drawer front, and an electrical connection assembly passing through the attachment assembly to provide electrical power to the indicator assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
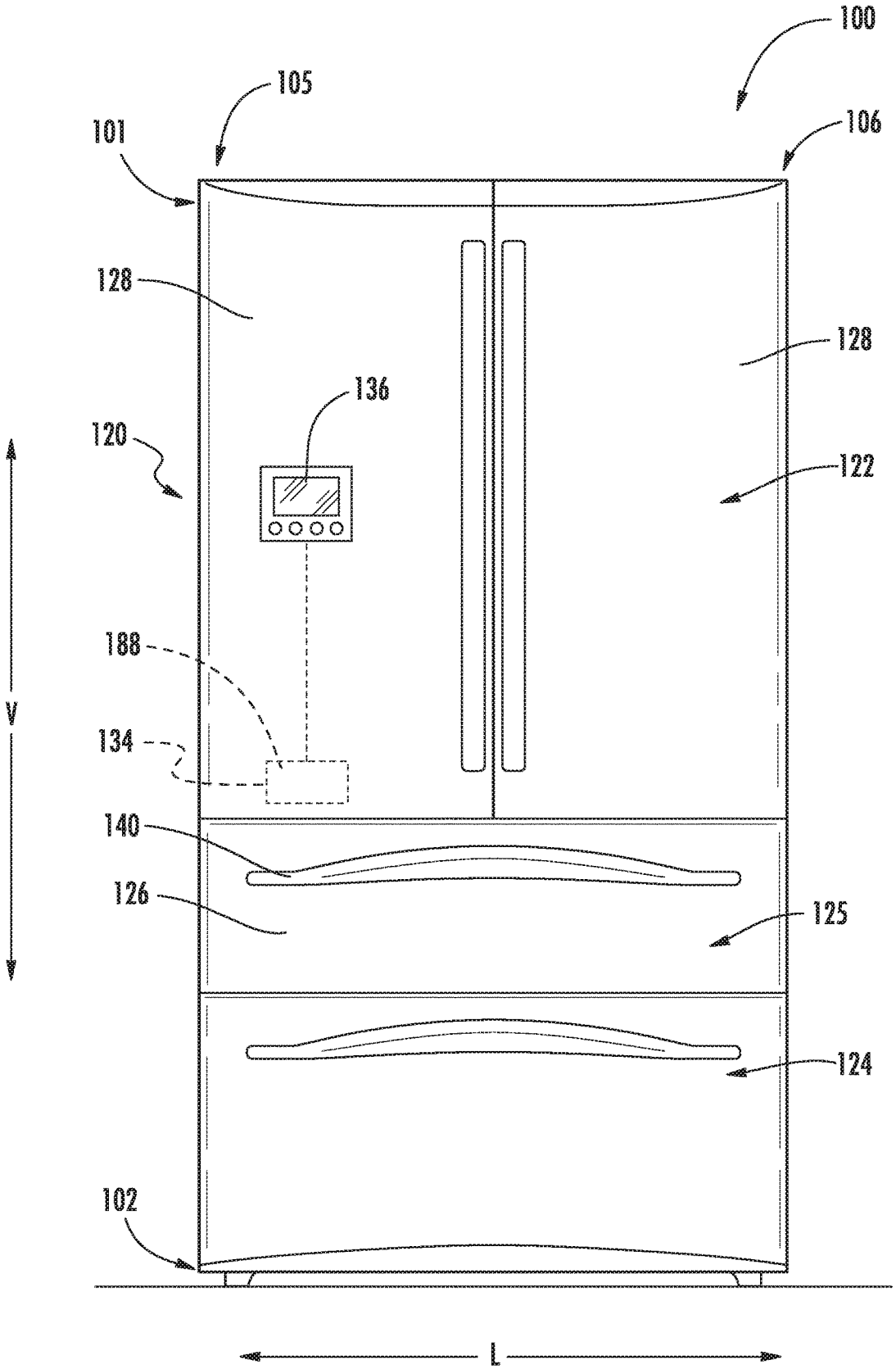
FIG. 1 provides a front view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

FIG. 1 is a front view of an exemplary embodiment of a refrigerator appliance 100. Refrigerator appliance 100 extends between a top 101 and a bottom 102 along a vertical direction V. Refrigerator appliance 100 also extends between a left side 105 and a right side 106 along a lateral direction L. A transverse direction T may additionally be defined perpendicular to the vertical and lateral directions V, L.

Refrigerator appliance 100 includes a cabinet or housing 120 defining an upper fresh food chamber 122 and a lower freezer chamber or frozen food storage chamber 124 arranged below the fresh food chamber 122 along the vertical direction V. Because the frozen food storage chamber 124 is positioned below the fresh food storage chamber 122, refrigerator appliance 100 is generally referred to as a bottom mount refrigerator. Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 128 are rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably coupled within freezer chamber 124.

Refrigerator appliance 100 may include a drawer 125. Drawer 125 may be positioned between refrigerator doors 128 and freezer door 130. Drawer 125 may be configured to be withdrawn from and inserted to cabinet 120 of refrigerator appliance. Drawer 125 may be received in a drawer recess. The drawer recess may be provided in fresh food chamber 122. The drawer recess may be provided in frozen food chamber 124. In some embodiments, a drawer recess is provided in each of fresh food chamber 122 and frozen food chamber 124. Drawer 125 may include a drawer front 126 and a handle 140 attached to drawer front 126. Handle 140 may be designed so as to be grasped by a user to open and close drawer 125 (i.e., withdraw and insert drawer 125 into the drawer recess).

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within one of the doors 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 134 via one or more signal lines or shared communication busses.

Figure 2:
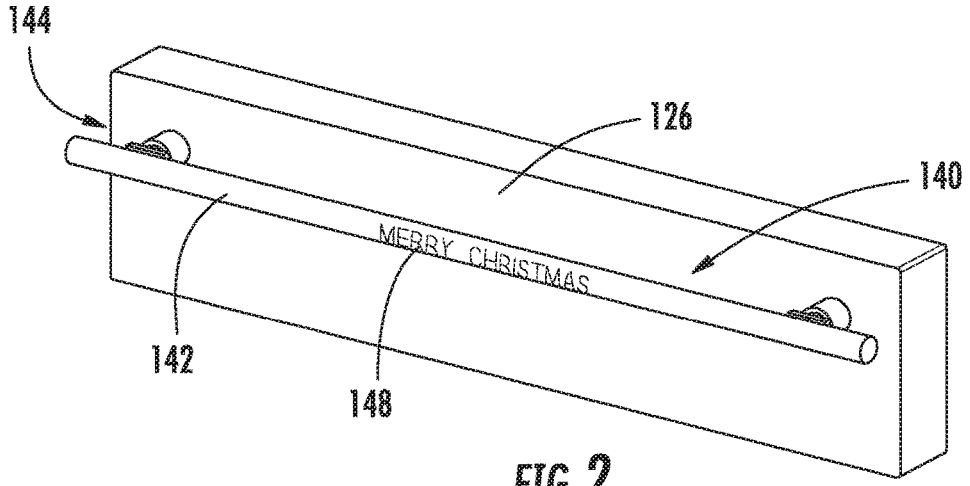
FIG. 2 provides a perspective view of a drawer front including a handle according to an exemplary embodiment of the present disclosure.

FIG. 2 is a perspective view of a drawer front of the exemplary drawer of FIG. 1. Drawer 125 may include drawer front 126. Drawer front 126 may be a panel covering an opening of the drawer recess. As described above, handle 140 may be removably attached to drawer front 126. For instance, handle 140 may be attached to drawer front 126 with an attachment assembly 144 allowing a quick release of handle 140 from drawer front 126, which will be described in more detail below. Handle 140 may include a handle body 142. In some embodiments, handle body 142 is tube-shaped. However, handle body 142 may be any suitable shape allowing a user to grasp handle body 142. In some embodiments, handle body 142 extends in the lateral direction L.

Handle body 142 may be hollow. For example, a tube-shaped handle body 142 can accommodate various components therein. Handle body 142 may further include a transparent portion 148. Transparent portion 148 may be a portion of handle body 142 through which a viewer may see the interior of handle body 142. In detail, an outer surface of handle body 142 may be cut or etched into various shapes or designs, such as letters, numbers, figures, or the like. In some embodiments, transparent portion 148 is a transparent material (e.g., glass, clear plastic, etc.) Additionally or alternatively, transparent portion 148 may be a window in handle body 142. Accordingly, light may pass through transparent portion 148 (e.g., from an interior of handle body 142 to an exterior thereof, or vice versa).

Figure 3:
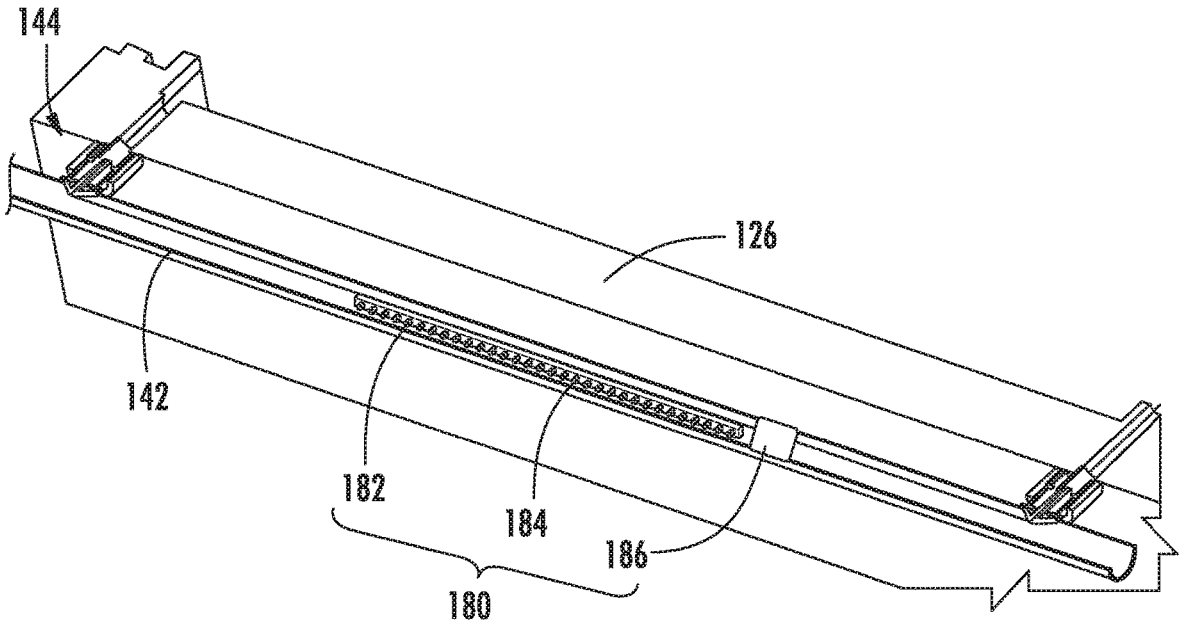
FIG. 3 provides a perspective cut-away view of the exemplary drawer front of FIG. 2.

FIG. 3 is a cut-away top view of the drawer front of FIG. 2. Handle body 142 may further include an indicator assembly 180 provided within handle body 142. Indicator assembly 180 may include a circuit board 182 arranged within the hollow handle body 142. Circuit board 182 may be any suitable circuit board capable of receiving and distributing an electrical signal to various electrical outputs, such as a printed circuit board (PCB), a flexible printed circuit board (FPCB), or the like. Circuit board 182 may receive an electrical signal from an electrical source 188 (FIG. 1). Electrical source 188 may be provided within cabinet 120 of refrigerator appliance 100. Additionally or alternatively, electrical source 188 may be a household electrical supply, such as a standard electrical grid. Electrical signals may be generated by electrical source 188 and delivered to circuit board 188 via an electrical connection assembly 171, which will be described in detail below. For instance, electrical signals are delivered through an attachment assembly 144 (described below) connecting handle 140 to drawer front 126.

Indicator assembly 180 may further include one or more light sources 184 electrically connected to circuit board 182. Light source 184 may emit light upon receiving electrical signals via circuit board 182. In some embodiments, light source 184 is a light emitting diode (LED). However, it should be understood that any suitable light source may be used as light source 184. Light source 184 may be attached directly to circuit board 182. Additionally or alternatively, light source 184 may be connected to circuit board 182 via one or more wires. In detail, light source 184 may be positioned adjacent to transparent portion 148, such that light produced by light source 184 is emitted through transparent portion 148 to an exterior of handle body 142. A plurality of light sources may be incorporated and arranged in predetermined patterns within handle body 142.

Indicator assembly 180 may further include a speaker 186 electrically connected to circuit board 182. Speaker 186 may emit sound upon receiving an electrical signal via circuit board 182. Speaker 186 may be any suitable type of speaker, such as a loudspeaker, a dynamic speaker, a digital speaker, or the like. Speaker 184 may be attached directly to circuit board 182. Additionally or alternatively, speaker 186 may be connected to circuit board 182 via one or more wires. In detail, speaker 186 may be positioned adjacent to transparent portion 148 (e.g., when transparent portion 148 is a cut-out or hole formed in handle body 142). Accordingly, sound produced by speaker 186 may be emitted to an exterior of handle body 142. A plurality of speakers 186 may be incorporated within handle body 142.

Figure 4:
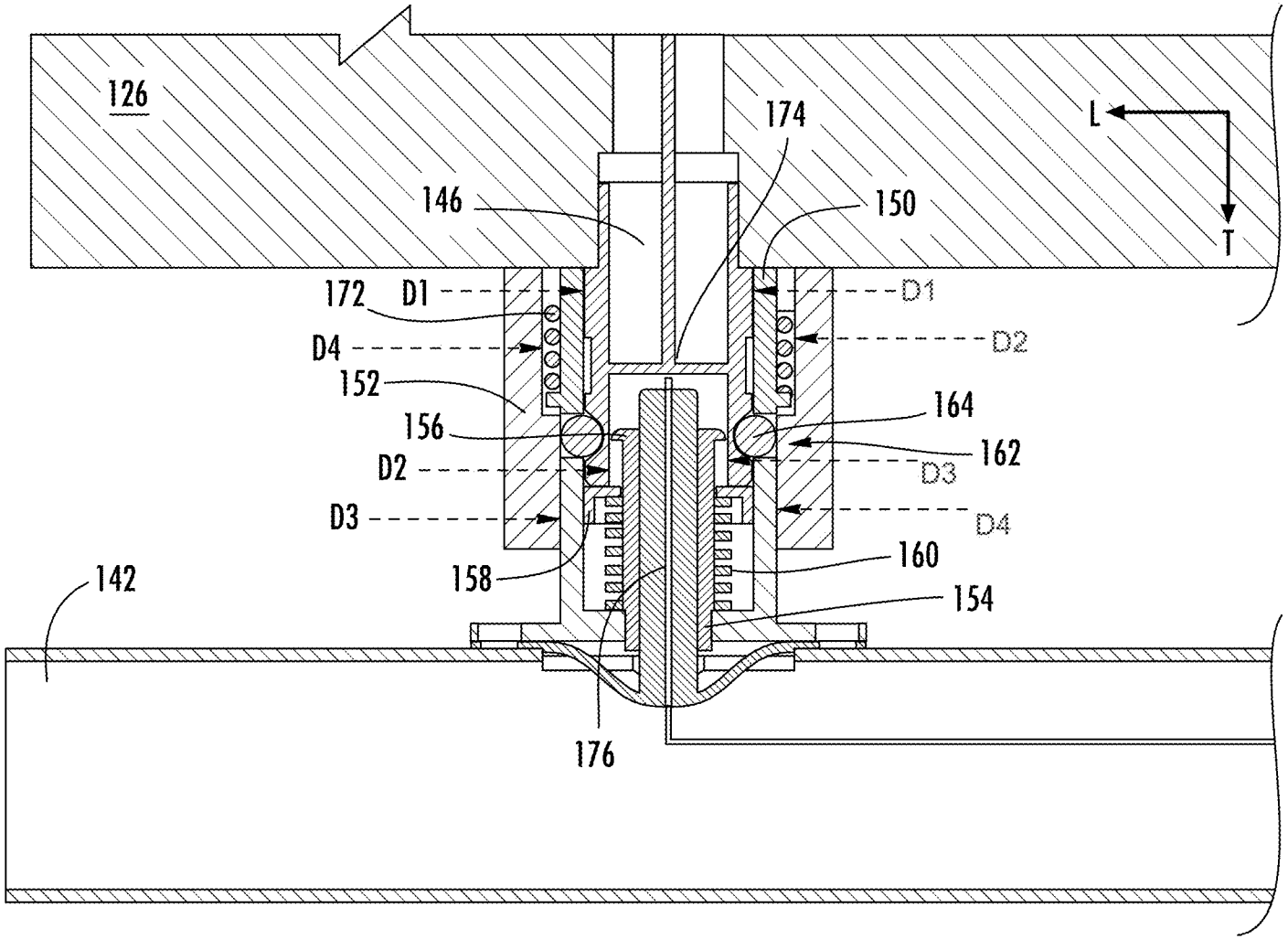
FIG. 4 provides a top cut-away view of a connection assembly of the exemplary drawer front of FIG. 2, with the handle attached to the drawer front.
Figure 5:
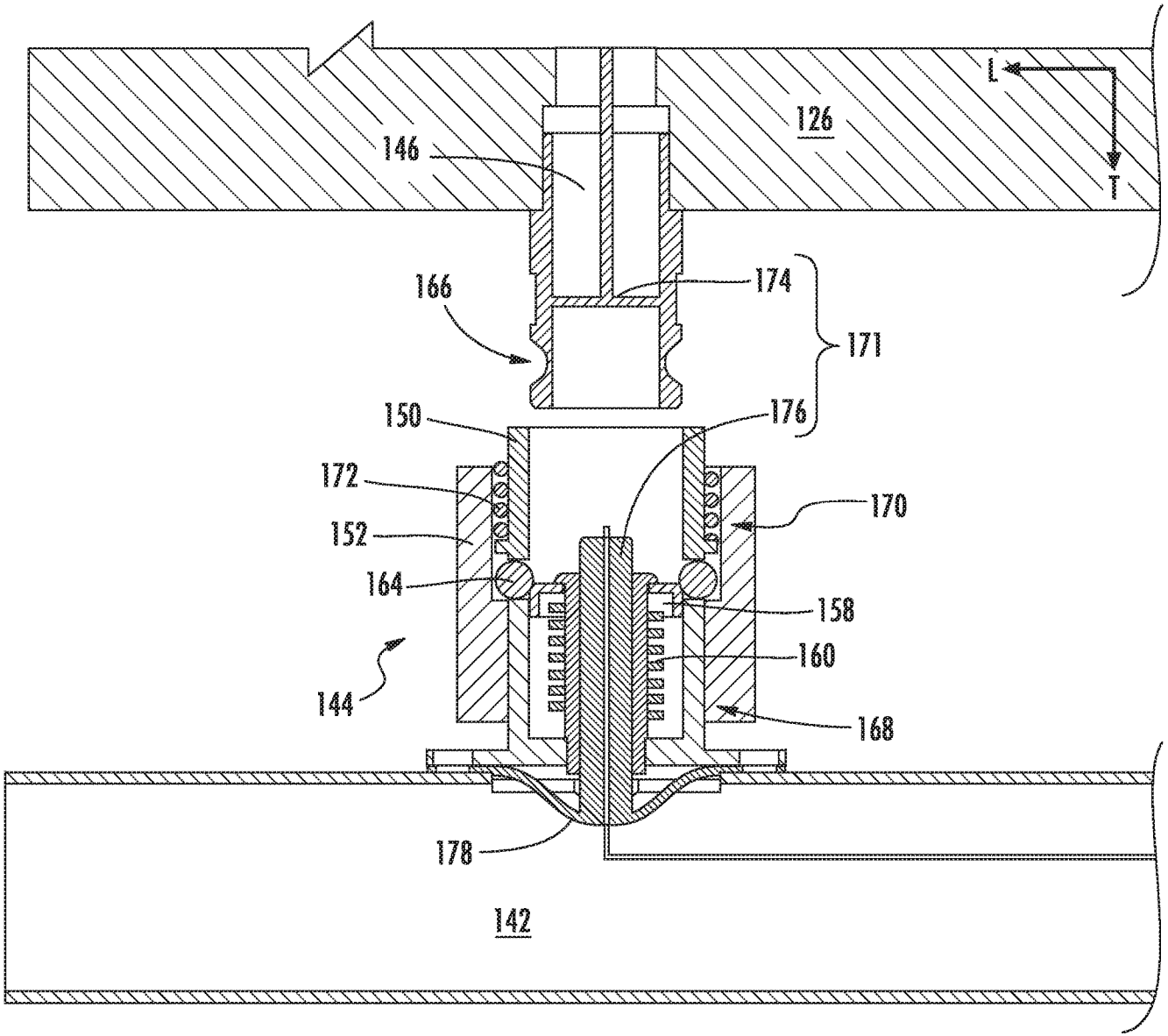
FIG. 5 provides a top cut-away view of the connection assembly of FIG. 4, with the handle detached from the drawer front.

FIG. 4 is a cut-away top view of an attachment assembly and electrical connection assembly of the exemplary drawer assembly of FIGS. 2 and 3 with the handle attached to the drawer front, and FIG. 5 is a cut-away top view of an attachment assembly and electrical connection assembly of the exemplary drawer assembly of FIGS. 2 and 3 with the handle detached from the drawer front. Referring to FIGS. 4 and 5, the drawer assembly may include an attachment assembly 144 for attaching handle 140 to drawer front 126. Advantageously, attachment assembly 144 may be a quick connect/release type assembly, allowing a user to release or attach handle 140 to drawer front 126 without the use of tools. Drawer front 126 may include a retainer post 146 extending from the drawer front 126. For example, retainer post 146 may protrude from a front surface of drawer front 126 and extend in the transverse direction T away from the interior of cabinet 120 of refrigerator appliance 100. Retainer post 146 may be a pipe having a circumferential wall and hollow interior. For instance, retainer post 146 may be cylindrical about an axis defined in the transverse direction. However, the shape of retainer post 146 is not limited to this example. Retainer post 146 may have an outer diameter D1. Retainer post may have an inner diameter D2 smaller than outer diameter D1.

Retainer post 146 may have a groove 166 formed in an outer circumferential surface thereof. Groove 166 may be an indentation in the outer circumferential surface of retainer post 146. Groove 166 may be spherically concave. A plurality of spherically concave grooves 166 may be formed circumferentially equidistant around the outer circumferential surface of retainer post 146. Additionally or alternatively, a single circumferential groove 166 may be formed around an entire circumference of retainer post 146.

Attachment assembly 144 may include a receiving tube 150 extending from handle body 142. Receiving tube 150 may extend substantially perpendicularly from handle body 142, such that when handle 140 is attached to drawer front 126, receiving tube 150 is coaxial with retainer post 146. Receiving tube 150 may be shaped similar to retainer post 146. Receiving tube 150 may have an inner diameter that is within a standard engineering tolerance of outer diameter D1 of retainer post, such that retainer post 146 is received within receiving tube 150 when handle 140 is attached to drawer front 126. Accordingly, when receiving tube 150 is placed onto retainer post 146, the outer circumferential surface of retainer post 146 may slide along the inner circumferential surface of receiving tube 150.

Although the exemplary embodiment illustrated and described herein includes retainer post 146 extending from drawer front 126 and being received within receiving tube 150 that extends from handle body 142, it should be appreciated that these parts may be reversed according to exemplary embodiments. In addition, other variations and modifications may be made to attachment assembly 144 while remaining within the scope of the present subject matter. For example, an orientation of retainer post 146 with respect to drawer front 126 (or handle body 142) and an orientation of receiving tube 150 with respect to handle body 142 (or drawer front 126) may be modified to any suitable angle (e.g., in the vertical direction V, for example). Additionally or alternatively, a cross-sectional shape of receiving tube 150 and/or retainer post 146 may be any suitable shape such that the two elements mate with each other.

A through hole 162 may be formed through receiving tube 150. Through hole 162 may be formed through a circumferential wall of receiving tube 150. Through hole 162 may be positioned at or near a midpoint of receiving tube 150. In some embodiments, a plurality of through holes 162 are formed circumferentially spaced around the circumference of receiving tube 150. A plug 164 may be movably positioned within through hole 162. For instance, plug 164 may move radially within through hole 162 (i.e., perpendicular to the axis of receiving tube 150). Plug 164 may be a ball (e.g., a steel ball, ball bearing, etc.) As shown in FIG. 4, when handle 140 is in the attached position, plug 164 may be received within groove 166 of retainer post 146. In detail, a first portion of plug 164 may be received within groove 166 while a second portion of plug 164 remains in through hole 162. Accordingly, the position of plug within both groove 166 and through hole 162 holds attachment assembly 144 in place, thus securing handle 140 to drawer front 126.

Attachment assembly 144 may include a pipe 154 coaxial with and provided within receiving tube 150. Pipe 154 may extend coaxial with receiving tube 150 from handle body 142. Pipe 154 may be tube-shaped and include a hollow interior. For instance, pipe 154 may be a hollow cylindrical tube. It should be noted that pipe 154 may be any suitable shape, however. Pipe 154 may include a lip 156 at a distal end thereof (i.e., distal from handle body 142). Lip 156 may extend radially from pipe 154. Lip 156 may be provided around the entire circumference of pipe 154. The distal end of pipe 154 may be positioned between a top point and a bottom point of through hole 162 in the transverse direction T. Additionally or alternatively, lip 156 may extend radially such that the diameter of lip 156 is within engineering tolerance of interior diameter D2 of retainer post 146. Accordingly, when handle 140 is in the attached position to drawer front 126, lip 156 may be received within retainer post 146.

Attachment assembly 144 may include a cup washer 158 arranged radially between receiving tube 150 and pipe 154. Cup washer 158 may be cylindrical. Cup washer 158 may be sized such that an outer circumferential surface thereof contacts the inner circumferential surface of receiving tube 150, and an inner circumferential surface thereof contacts the outer circumferential surface of pipe 154. Cup washer 158 may be movable. For example, cup washer 158 may translate (i.e., reciprocate) in the axial direction of receiving tube 150. Cup washer 158 may be restrained in the transverse direction T by lip 156 of pipe 154. In other words, cup washer 158 is provided between lip 156 and handle body 142 and is restrained against a bottom surface of lip 156 when handle 140 is in the detached position.

Additionally or alternatively, when handle 140 is in the detached position and cup washer 158 is restrained against lip 156, cup washer 158 may contact plug 164. In some embodiments, cup washer 158 contacts each plug incorporated, as designs warrant. Conversely, when handle 140 is in the attached position, a distal end of retainer post 146 may push cup washer toward handle body 142. Accordingly, when groove 166 becomes aligned with through hole 162, plug 164 is received into groove 166, locking handle 140 in the attached position.

Cup washer 158 may be biased by a cup washer spring 160. Cup washer spring 160 may be a resilient member positioned between cup washer 158 and handle body 142. For instance, cup washer spring 160 may be a coil spring, an elastic spacer, or the like. Cup washer spring 160 may bias cup washer 158 away from handle body 142 in the transverse direction T (i.e., toward lip 156 of pipe 154). Thus, when handle 140 is in the detached position, cup washer 158 is constantly biased against lip 156. Advantageously, this maintains plug 164 in a retracted position, allowing receiving tube 150 to be freely inserted over retainer post 146.

Attachment assembly 144 may include a sleeve 152 surrounding receiving tube 150. Sleeve 152 may be configured to slide axially along receiving tube 150 (i.e., in the transverse direction T). Sleeve 152 may be predominantly cylindrical in shape. In detail, sleeve 152 may have a shape similar to a shape of receiving tube 150. Sleeve 152 may include a first inner circumferential surface 168, and a second inner circumferential surface 170. First inner circumferential surface 168 may have a first diameter that is within engineering tolerance of the outer circumferential surface of receiving tube 150. Accordingly, sleeve 152 may reciprocate smoothly along the outer circumferential surface of receiving tube 150. Second inner circumferential surface 170 may have a second diameter D4 that is larger than the diameter of first inner circumferential surface 168. Second inner circumferential surface 170 may be provided closer to drawer front 126 than first inner circumferential surface 168 (i.e., in the transverse direction T). The difference between the diameter D3 of the first inner circumferential surface 168 and the diameter D4 of the second inner circumferential surface 170 is sufficient to allow plug 164 to disengage from groove 166.

In detail, sleeve 152 may be movable in the transverse direction T along receiving tube 150. As shown in FIG. 4, when handle 140 is in the attached position to drawer front 126, sleeve 152 may be in a first position. In the first position, first inner circumferential surface 168 is adjacent to through hole 162. Accordingly, plug 164 is held in place within groove 166 due to radially inward pressure from first inner circumferential surface 168.

As shown in FIG. 5, when handle 140 is in the detached position to drawer front 126, sleeve 152 may be in a second position. In the second position, second inner circumferential surface 170 is adjacent to through hole 162. Accordingly, plug is disengaged from groove 166, and receiving tube 150 may be easily pulled off of retainer post 146. Additionally or alternatively, as mentioned above, when handle 140 is in the detached position to drawer front 126, cup washer 158 may be biased against lip 156. Thus, plug 164 is restrained in the disengaged position against second inner circumferential surface 170. Because of the difference between D4 and D3, sleeve 152 may be held in the second position until handle 140 is replaced onto retainer post 146.

Attachment assembly 144 may include a sleeve spring 172. Sleeve spring 172 may bias sleeve 152 in the transverse direction T away from handle body 142. Sleeve spring 172 may be a resilient member capable of biasing sleeve 152. For example, sleeve spring 172 may be a coil spring, an elastic spacer, or the like. In some embodiments, sleeve spring 172 surrounds receiving tube 150 and is positioned between the outer circumferential surface of receiving tube 150 and second inner circumferential surface 170 of sleeve 152.

The drawer assembly may include an electrical connection assembly 171. Electrical connection assembly 171 may include a first electrical connector 174, a second electrical connector 176, and a second electrical connector spring 178. First electrical connector 174 may be provided within drawer front 126. For example, first electrical connector 174 may be provided within retainer post 146. First electrical connector 174 may be a terminal capable of delivering electrical signals to a coupled connector (e.g., second electrical connector 176). First electrical connector 174 may be electrically connected to electrical source 188.

Second electrical connector 176 may be provided in handle 140. For example, second electrical connector 176 may be provided within receiving tube 150. Second electrical connector 176 may be a terminal capable of receiving electrical signals from a coupled connector (e.g., first electrical connector 174). Second electrical connector 176 may be electrically connected to circuit board 182.

Second electrical connector spring 178 may be a resilient member configured to bias second electrical connector 176 away from handle body 142 (i.e., in the transverse direction T). Second electrical connector spring 178 may be any suitable spring capable of biasing second electrical connector 176, such as a leaf spring, a coil spring, an elastic spacer, or the like. Second electrical connector spring 178 may be provided within handle body 142 at a proximal end of second electrical connector 176.

When handle 140 is attached to drawer front 126 (FIGS. 3 and 4), first electrical connector 174 may contact second electrical connector 176, creating a complete circuit from electrical source 188 to circuit board 182. Second electrical connector spring 178 may ensure second electrical connector 176 remains in electrical contact with first electrical connector 174. Accordingly, electrical signals from electrical source 188 may be transmitted to circuit board 182. Consequently, light source 184 may emit light according to instructions from controller 134. Additionally or alternatively, speaker 186 may emit sound according to instructions from controller 134.

It should be noted that the above described attachment assembly and electrical connection assembly may be incorporated into a variety of appliances, such as refrigerators, microwaves, ovens, dishwashers, etc. Accordingly, the disclosure is not limited solely to the refrigerator discussed above. Moreover, it should be appreciated that the handle assembly described herein may be incorporated into a variety of different handles, particularly different handles having different transparent portions formed in different designs. Accordingly, a user may interchange handles according to different occasions to emphasize a particular occasion (i.e., birthdays, holidays, etc.). Advantageously, user may easily change handles to accommodate different desires.

Aspects of the subject matter described herein facilitate improved user interaction with easily detachable and attachable handle assemblies that include displays, indicators, speakers, and/or other devices for improved user interaction. The attachment and detachment of the handle assembly is simplified through the use of attachment assembly. In this regard, as described above, a user may attach a compatible handle by pulling back the sleeve to free the plug from the groove formed in the retainer post. Thus, the handle assembly may be easily removed from the drawer front without the use of tools. In the same manner, a user may position the handle so as to slide the retainer post into the receiving tube, which in turn pushes the cup washer into a retracted position, thus allowing the plug to be received within groove after the retainer post is in a fully engaged position. The user may then release the sleeve to lock the plug into the retainer post and secure the handle to the drawer front. This also establishes an electrical connection through the electrical connection assembly to power the indicator assembly, including the light source and the speaker, for example.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A drawer assembly for an appliance, the drawer assembly comprising:

a drawer front comprising a retainer post extending from the drawer front;

a handle comprising:

an indicator assembly;

a handle body extending in a first direction;

a receiving tube extending in a second direction from the handle body and defining an adapter cavity to receive the retainer post; and a sleeve surrounding the retainer post;

an attachment assembly for removably attaching the handle to the drawer front; and an electrical connection assembly passing through the attachment assembly to provide electrical power to the indicator assembly, wherein the electrical connection assembly comprises:

a first electrical connector provided within the retainer post; and a second electrical connector provided within the receiving tube; wherein the first electrical connector contacts the second electrical connector to form a complete electrical circuit when the retainer post is received within the receiving tube.

2. The drawer assembly of claim 1, wherein the handle further comprises a resilient member configured to bias the second electrical connector in the second direction away from the handle body.

3. The drawer assembly of claim 1, wherein the indicator assembly comprises a circuit board electrically connected to the second electrical connector.

4. The drawer assembly of claim 3, wherein the first electrical connector is electrically connected to an electrical source through the appliance.

5. The drawer assembly of claim 3, wherein the handle body comprises a transparent portion.

6. The drawer assembly of claim 5, wherein the indicator assembly further comprises a light source electrically connected to the circuit board and positioned adjacent to the transparent portion.

7. The drawer assembly of claim 3, wherein the indicator assembly further comprises a speaker electrically connected to the circuit board.

8. The drawer assembly of claim 1, wherein the attachment assembly further comprises a pipe coaxial with and provided within the receiving tube, the pipe comprising a lip at a distal end thereof and extending radially outward.

9. The drawer assembly of claim 8, wherein the attachment assembly further comprises:

a cup washer arranged radially between the receiving tube and the pipe; and a resilient member biasing the cup washer in the second direction, wherein the cup washer is restrained by the lip of the pipe.

10. The drawer assembly of claim 9, wherein the receiving tube defines a through hole extending through a circumferential wall of the receiving tube, and wherein the drawer assembly further comprises a plug movably received within the through hole.

11. The drawer assembly of claim 10, wherein the plug is a ball bearing.

12. The drawer assembly of claim 10, wherein a groove is defined in an outer circumferential surface of the retainer post, and wherein the groove is configured to accept the plug.

13. The drawer assembly of claim 10, wherein the sleeve comprises a first inner circumferential surface defining a first diameter and a second inner circumferential surface defining a second diameter, the second diameter being larger than the first diameter.

14. The drawer assembly of claim 1, further comprising a resilient member configured to bias the sleeve in the second direction away from the handle body.

15. A refrigerator appliance, comprising:

a cabinet defining a fresh food storage chamber and a frozen food storage chamber; and a drawer slidably mounted within one of the fresh food storage chamber and the frozen food storage chamber and defining a drawer recess, wherein the drawer comprises a drawer front comprising a retainer post extending from the drawer front, a handle comprising a handle body and a receiving tube extending from the handle body and defining an adapter cavity to receive the retainer post, an attachment assembly for removably attaching the handle to the drawer front, and an electrical connection assembly passing through the attachment assembly to provide electrical power to the handle body, a circuit board provided within the handle and configured to receive an electrical signal;

a light source electrically connected to the circuit board; and a speaker electrically connected to the circuit board.

16. The refrigerator appliance of claim 15, wherein the handle further comprises:

a sleeve surrounding the receiving tube and configured to slide axially along the receiving tube.

17. The refrigerator appliance of claim 16, wherein the electrical connection assembly comprises:

a first electrical connector provided within the retainer post; and a second electrical connector provided within the receiving tube; wherein the first electrical connector contacts the second electrical connector to form a complete electrical circuit when the retainer post is received within the receiving tube.

18. The refrigerator appliance of claim 17, wherein the circuit board is electrically connected to the second electrical connector so as to receive the electrical signal from the second electrical connector.

19. A drawer assembly for an appliance, the drawer assembly comprising:

a drawer front comprising a retainer post extending from the drawer front;

a handle comprising a receiving tube extending therefrom and an indicator assembly provided therein, the receiving tube configured to selectively receive the retainer post;

an attachment assembly for removably attaching the handle to the drawer front; and an electrical connection assembly passing through the attachment assembly to provide electrical power to the indicator assembly, wherein the attachment assembly further comprises a pipe coaxial with and provided within the receiving tube, the pipe comprising a lip at a distal end thereof and extending radially outward.

20. The drawer assembly of claim 19, wherein the electrical connection assembly comprises:

a first electrical connector provided within the retainer post; and a second electrical connector provided within the receiving tube; wherein the first electrical connector contacts the second electrical connector to form a complete electrical circuit when the retainer post is received within the receiving tube.

* * * * *